US008062153B2

(12) United States Patent
Boseman

(10) Patent No.: US 8,062,153 B2
(45) Date of Patent: Nov. 22, 2011

(54) PING PONG BALL TETHER ATTACHMENT

(76) Inventor: Reed Boseman, Bath, NC (US)

( * ) Notice: Subject to any disclaimer, the term of this patent is extended or adjusted under 35 U.S.C. 154(b) by 0 days.

(21) Appl. No.: 12/750,306

(22) Filed: Mar. 30, 2010

(65) Prior Publication Data

US 2011/0244994 A1 Oct. 6, 2011

(51) Int. Cl.
*A63B 67/04* (2006.01)

(52) U.S. Cl. ..... 473/496; 473/475

(58) Field of Classification Search ..... 473/496, 473/422, 423, 427, 429, 430, 490, 491, 473–475; 273/331
See application file for complete search history.

(56) References Cited

U.S. PATENT DOCUMENTS 2,111,339 A * 3/1938 Squires ..... 473/475
2,769,636 A * 11/1956 Finestone ..... 473/475
3,477,717 A * 11/1969 Clark ..... 473/475
3,809,406 A * 5/1974 Lohr et al. ..... 473/575
3,945,641 A * 3/1976 Carbonero ..... 473/469
4,523,762 A * 6/1985 Garner, Sr. ..... 473/473
5,348,293 A * 9/1994 Smith ..... 473/474
7,429,223 B2 * 9/2008 Dovrat et al. ..... 473/474
7,824,282 B2 * 11/2010 Wycoff ..... 473/473
2009/0051116 A1 * 2/2009 Offland ..... 273/331
2010/0009784 A1 * 1/2010 Wycoff ..... 473/429

* cited by examiner

*Primary Examiner* — Raleigh W. Chiu
(74) *Attorney, Agent, or Firm* — Jerry D. Haynes; The Law Office of Jerry D. Haynes

(57) ABSTRACT

A system for tethering a ping-pong ball comprising: a ping-pong table, where said ping-pong table includes a net extended across the center of the table; an arch support attachment, where said support attachment includes two vertical posts, where said posts are attached to each end of the net and an arched center portion that extends between the two vertical posts; a tether line; a line attachment clip, where said clip is attached to the center of the support attachment and provides a means to secure one end of the tether line; and a ball attached to the opposite end of the tether line.

7 Claims, 1 Drawing Sheet

PING PONG BALL TETHER ATTACHMENT

BACKGROUND OF THE INVENTION

1. Field of Invention

The present invention relates to a tether attachment for a ping-pong ball to support play of a tethered ping-pong ball.

2. Description of Related Art

Ping-pong also known as table tennis is a popular indoor sport enjoyed by many individuals that involves 2 to 4 players that strike a small hollow ball across a table that includes a net across the center thereof. Points are scored when a player fails to return a ball that has been served or returned from the opposite side of the net.

As stated above, points are scored when a player is unable to return a ball that is been served or returned back to him after his serve. The back and forth of the ball over the net is the principal object of the game. Consequently, when a player is unable to return a ball, the ball continues its trajectory off the table and usually falls on the floor. Players during the course of the game must continually retrieve balls that have fallen onto the floor. Occasionally when these balls are dropped or land on the floor they may be damaged or even lost. Consequently, it would be advantageous if a device could be utilized where the ball remains within the table area or remains suspended near the table to alleviate the retrieval problem discussed above.

SUMMARY OF THE INVENTION

The present invention relates to a system for tethering a ping-pong ball comprising: a ping-pong table, where said ping-pong table includes a net extended across the center of the table; an arch support attachment, where said support attachment includes two vertical posts, where said posts are attached to each end of the net and an arched center portion that extends between the two vertical posts; a tether line; a line attachment clip, where said clip is attached to the center of the support attachment and provides a means to secure one end of the tether line; and a ball attached to the opposite end of the tether line. The arch support attachment may be centered over the net and is of sufficient height to provide a clear pathway for the ball that may be in play on the ping-pong table. The tether line is of sufficient length in order to provide enough movement for the ball during a ping-pong game.

DETAILED DESCRIPTION

Figure 1:
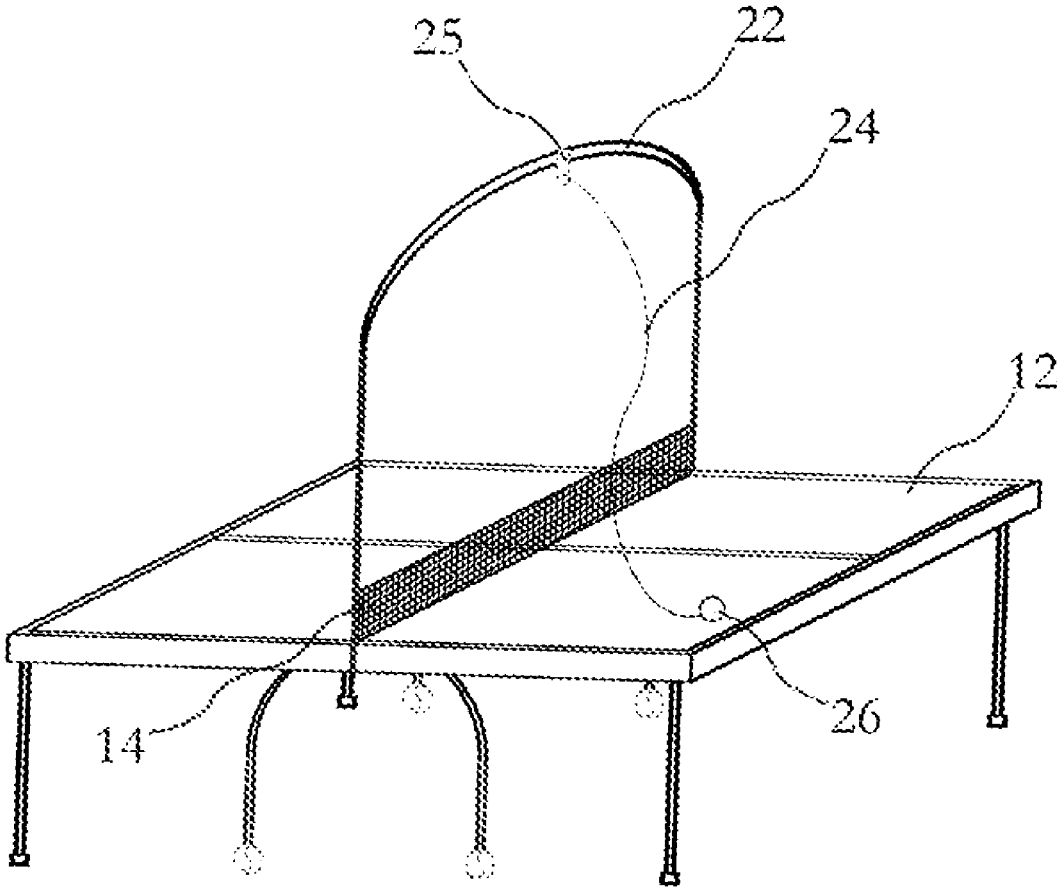
FIG. 1 depicts use of a tethered ping-pong ball attachment according to the present invention.

The present invention provides an attachment for a ping-pong table that includes a tethered ball that may be used during the course of a ping-pong game. The ball is tethered to an archway that is suspended over the ping-pong table and centered in line with the net of the ping-pong table. The ball is tethered to this archway and therefore cannot be dropped to the floor or lost during the course of a ping-pong game.

FIG. 1 depicts an Arch Support Attachment 22 attached to a Ping-Pong Table 12. The Arch Attachment 22 is centered over a Net 14 that stretches across the center of the Ping-Pong Table 12. The Arch Support Attachment 22 is of sufficient height to provide a clear pathway for a ball that may be in play on the ping-pong table. The Support Attachment 22 includes a Line Attachment Clip 25 that provides a means to secure one end of the Tether Line 24. At the opposite end of the Tether Line 24, a Ball 26 is attached thereto. The Ball 26 is a conventional ping-pong ball that is used for table tennis on the Ping-Pong Table 12. The Tether Line 24 is of sufficient length in order to provide enough movement for the Ball 26 so that players may play a ping-pong game. The length of the Tether Line 24 is however limited to avoid the ball falling to the ground on the occasion that the player is unable to return a serve.

The Support Attachment 22 may be constructed of PVC piping where the support attachment is one composite piece. In one exemplary embodiment, the Support Attachment 22 may include two posts that are attached at the ends of the Net 14 and an arch support that stretches over and connects the two posts. The Line Attachment Clip 25 depicted in FIG. 1 may be positioned at the center of the arched attachment. The Tethered Line 24 is a tangle free line that is attached to the ping-pong ball but does not interfere with the movement of the ball as it is struck back and forth over the net during a game.

This unique support attachment for a tethered ping-pong ball enables the play of ping-pong without the hassle of ball retrieval that is usually associated with a game of ping-pong on a table. The ball remains attached to the tethered line and therefore the players will not have to bend over to pick up the ball nor will the ball be lost when it's struck off the table. The use of the support attachment makes the playing of ping-pong more enjoyable for players and eliminates some of the hassles associated with a ping-pong game. The instant invention has been shown and described in what it considers to be the most practical and preferred embodiments. It is recognized, however, that departures may be made there from within the scope of the invention and that obvious modifications will occur to a person skilled in the art.

What is claimed is:

1. A system for tethering a ping-pong ball comprising:

a. a ping-pong table, where said ping-pong table includes a net extended across the center of the table;

b. an arch support attachment, where said support attachment includes two vertical posts, where said posts are attached to each end of the net and an arched center portion that extends between the two vertical posts;

c. a tether line;

d. a line attachment clip, where said clip is attached to the center of the support attachment and provides a means to secure one end of the tether line; and e. a ball attached to the opposite end of the tether line, wherein the arch support attachment is of sufficient height to provide a clear pathway for ball movement under the arch support attachment across the ping-pong table.

2. The system for tethering a ping-pong ball according to claim 1, where the arch support attachment is centered over the net.

3. The system for tethering a ping-pong ball according to claim 1, where the tether line is of sufficient length in order to provide enough movement for the ball during a ping-pong game.

4. The system for tethering a ping-pong ball according to claim 1, where the support attachment is constructed of PVC piping.

5. The system for tethering a ping-pong ball according to claim 1, where the support attachment is one composite piece.

6. The system for tethering a ping-pong ball according to claim 1, where the support attachment includes two posts that are attached at the ends of the net and an arch support that stretches over and connects the two posts.

7. The system for tethering a ping-pong ball according to claim 1, where the tethered line is a tangle free line.

* * * * *